United States Patent [19]

Garrido et al.

[11] Patent Number: 4,657,037

[45] Date of Patent: Apr. 14, 1987

[54] LABORER SUN PROTECTOR

[76] Inventors: Humberto Garrido; George Spector, both of 233 Broadway, Rm. 3615, New York, N.Y. 10007

[21] Appl. No.: 721,178

[22] Filed: Apr. 8, 1985

[51] Int. Cl.[4] ..... E04H 15/04; A45B 11/00; A45B 11/02

[52] U.S. Cl. ..... 135/90; 135/21; 224/190

[58] Field of Search ..... 135/90, 117, 16, 19.5, 135/21; 224/186, 187, 188, 189, 190

[56] References Cited

U.S. PATENT DOCUMENTS

| | | | |
|---|---|---|---|
| 176,675 | 4/1876 | Palmieri | 135/90 X |
| 229,912 | 7/1880 | Ray | 135/90 X |
| 237,518 | 2/1881 | Gray | 135/90 X |
| 578,572 | 3/1897 | Lashells | 135/90 X |
| 725,069 | 4/1903 | Gill | 135/90 X |
| 1,469,111 | 9/1923 | Russell | 135/87 X |
| 1,888,909 | 11/1932 | Crosthwait | 135/117 X |
| 1,973,540 | 9/1934 | Nelson | 135/90 |
| 3,177,881 | 4/1965 | Covington | 135/16 |
| 3,204,650 | 9/1965 | Shinew | 135/16 |
| 4,112,957 | 9/1978 | Biven | 135/90 X |

*Primary Examiner*—Robert A. Hafer
*Assistant Examiner*—D. N. Muir

[57] ABSTRACT

A sun protector for a person is provided and consists of a cover disc rotatably mounted to the top of a vertical support bracket that is secured to the back of the person by belts. A piece of flexible material is affixed to a portion of the circumference of the cover disc so that the material will hang down to block the sun's rays from the head of the person when the cover disc is manually rotated to a proper position.

2 Claims, 4 Drawing Figures

LABORER SUN PROTECTOR

BACKGROUND OF THE INVENTION

The instant invention relates generally to sun shade devices and more specifically it relates to a sun protector for a person.

Numerous sun shade devices have been provided in prior art that are adapted to be attached to the body in order to free the hands. For example, U.S. Pat. Nos. 2,434,526; 3,554,203 and 4,188,965 all are illustrative of such prior art. While these units may be suitable for the particular purpose to which they address, they would not be as suitable for the purpose of the present invention as heretofore described.

SUMMARY OF THE INVENTION

A principle object of the present invention is to provide a sun protector for a person that allows the person working in the open to protect themself against the sun without using their hands to hold the sun protector.

Another object is to provide a sun protector for a person that will allow free flow of air to keep the person comfortable when working in the open.

An additional object is to provide a sun protector for a person that is adjustable, has a fan and a stretch material back support to inhance the comfort of the person.

A further object is to provide a sun protector for a person that is economical in cost to manufacture.

A still further object is to provide a sun protector for a person that is simple and easy to use.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
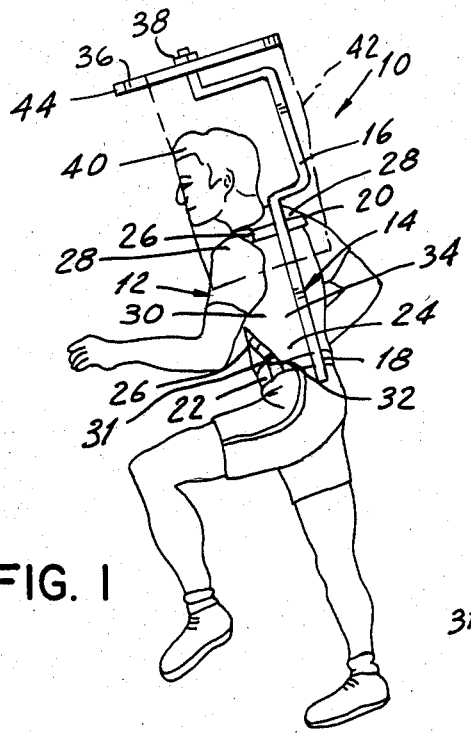
FIG. 1 is a side view of the invention attached on the body of a person.
Figure 2:
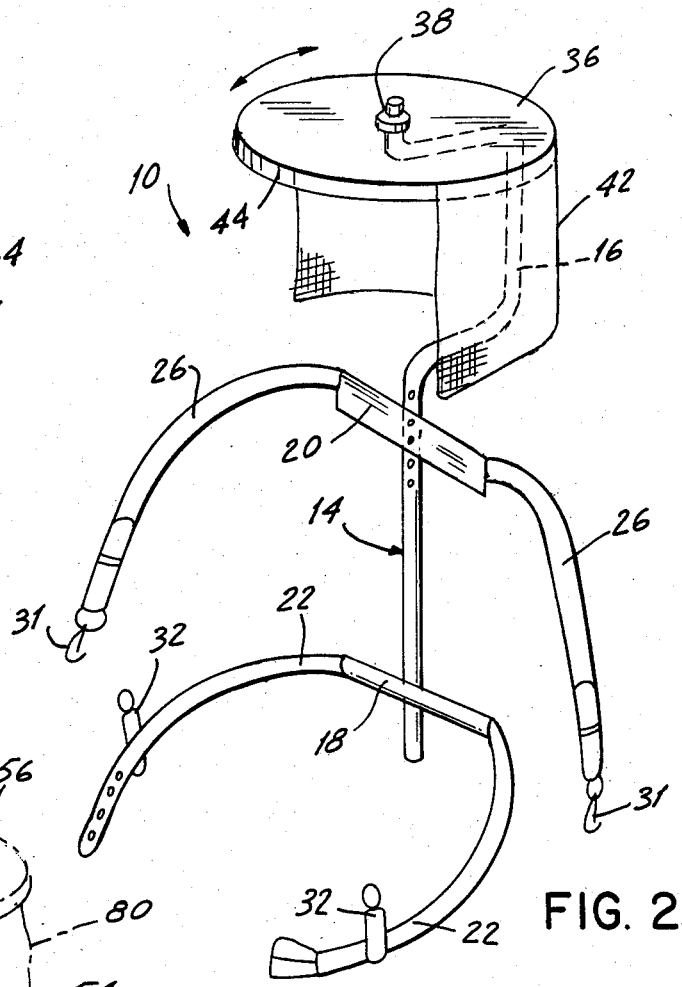
FIG. 2 is a perspective view thereof.

Turning now descriptively to the drawings, in which similar reference characters denote similar elements throughout the several views, FIGS. 1 and 2 illustrates a sun protector 10 for a person 12 and contains a substantially vertical support bracket 14 that has a C-shaped bent portion 16 near top thereof. A lower horizontal support bracket 18 is mounted transversely across the vertical support bracket 14, while an upper horizontal support bracket 20 is mounted transversely across the vertical support bracket 14.

A waist belt 22 is adapted to extend around the waist 24 of the person 12 for securing the lower horizontal support bracket 18 to the waist of the person. A cross belt 26 is adapted to extend over shoulders 28, across body 30 of the person 12 and clipped by clips 31, 31 onto the waist belt 22 at 32, 32 for securing the upper horizontal support bracket 20 to the back 34 of the person.

A cover disc 36 is rotatably mounted at 38 to top of the C-shaped bent portion 16 of the vertical support bracket 14 in a horizontal position above head 40 of the person 12. A piece of flexible material 42, such as cloth, is affixed to a portion of the circumference 44 of the cover disc 36 so that the material 42 will hang down to block the suns rays when the cover disc 36 is manually rotated to a proper position.

Figure 3:
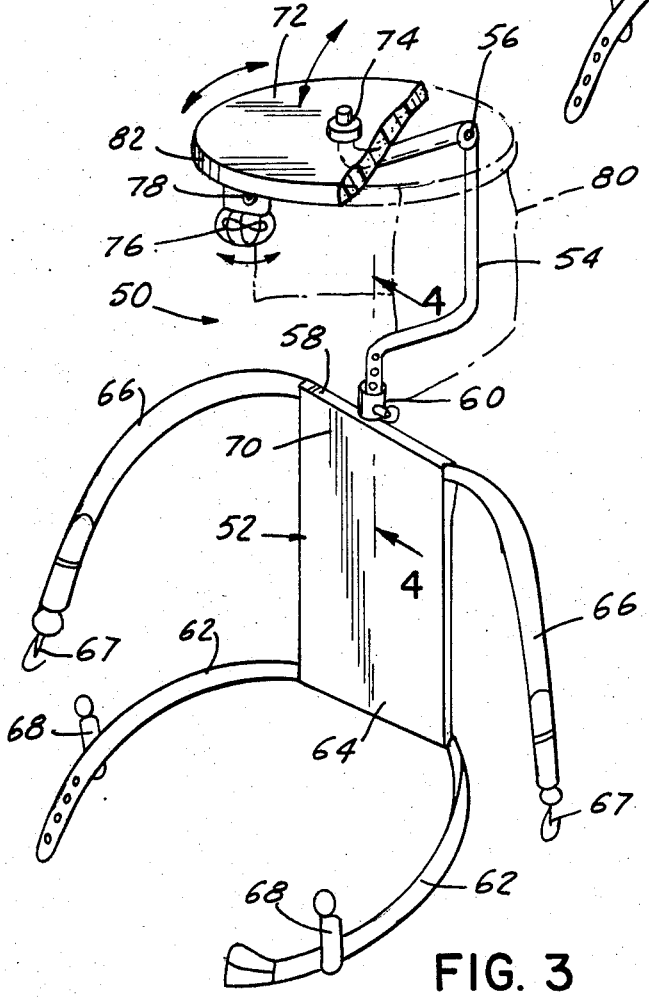
FIG. 3 is a perspective view similar to FIG. 2 with parts broken away of a modification being adjustable and having a fan and stretch material back support.

FIG. 3 shows a modified sun protector 50 for the person 12 and contains a stretch material back support plate 52. A vertical C-shaped support bracket 54 that has a ball pivot 56 which is adjustably affixed to top 58 of the back support plate by an adjustment device 60.

A waist belt 62 is adapted to extend around the waist 24 of the person 12 for securing the lower portion 64 of the back support plate 52 to the waist of the person. A cross belt 66 is adapted to extend over shoulders 28, across body 30 of the person 12 and clipped by clips 67, 67 onto the waist belt 62 at 68, 68 for securing the upper portion 70 of the back support plate 52 to the back 34 of the person.

A cover disc 72 is rotatably mounted at 74 to top of the vertical C-shaped support bracket 54 in a horizontal position above head 40 of the person 12. The cover disc 72 can be adjusted out of the horizontal position by the ball pivot joint 56 of the vertical C-shaped support bracket.

A fan 76 is adjustably affixed at 78 to underside of the cover disc 72 for cooling the person 12. A piece of flexible material 80 is affixed to a portion of the circumference 82 of the cover disc 72 so that the material 80 will hang down to block the sun's rays when the cover disc 72 is manually rotated and adjusted to a proper position.

Figure 4:
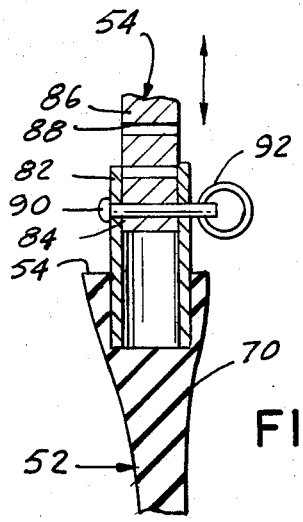
FIG. 4 is an enlarged cross sectional view taken along line 4—4 in FIG. 3 showing the telescopic adjustment in more detail.

FIG. 4 shows the adjustment device 60 in greater detail. A hollow sleeve 82 that has a transverse hole 84 affixed to top 58 of the back support plate 52. The bottom end 86 of the C-shaped support bracket 54 has a plurality of transverse holes 88 therethrough. When one of the holes 88 is in alignment with hole 84 a pin 90 with ring clip 92 can be installed as shown.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A sun protector for a person which comprises:

(a) a stretch material back support plate having an upper support sleeve adapted to adjustably receive a bracket;

(b) a vertical C-shaped support bracket having a pivotable joint, said support bracket mounted adjustably on said sleeve;

(c) first means for securing lower portion of said back support plate to waist of said person;

(d) second means for securing upper portion of said back support plate to back of said person said second means comprising straps integral with said stretch material back support plate;

(e) a cover disc rotatably mounted to top of said vertical C-shaped support bracket in a horizontal position above head of said person whereby said cover disc can be rotated and adjusted out of said horizontal position by said pivotable joint of said vertical C-shaped support bracket;

(f) a fan adjustably affixed to underside of said cover disc for cooling said person; and (g) a piece of flexible material affixed to a portion of the circumference of said cover disc so that said material will hang down to block the sun's rays when said cover disc is manually rotated and adjusted to a proper position.

2. A sun protector as recited in claim 1, wherein said first securing means includes a waist belt being adapted to extend around said waist of said person, wherein said second securing means includes a cross belt being adapted to extend over shoulders, across body of said person and clipped onto said waist belt, wherein said bracket includes a lower rod with spaced perforations and said sleeve includes holes which can be aligned with said perforations to receive a securing pin.

* * * * *